US006715165B1

(12) United States Patent
Schommer

(10) Patent No.: US 6,715,165 B1
(45) Date of Patent: Apr. 6, 2004

(54) LEAK DETECTION SYSTEM FOR PLUMBING FIXTURES

(76) Inventor: John E. Schommer, 2343 Summerhill Dr., Encinitas, CA (US) 92024

( * ) Notice: Subject to any disclaimer, the term of this patent is extended or adjusted under 35 U.S.C. 154(b) by 447 days.

(21) Appl. No.: 08/642,962

(22) Filed: May 6, 1996

(51) Int. Cl.[7] ..... E03D 1/00

(52) U.S. Cl. ..... 4/661; 4/314

(58) Field of Search ..... 4/661, 314

(56) References Cited

U.S. PATENT DOCUMENTS 4,918,763 A * 4/1990 Brotcke ..... 4/331

OTHER PUBLICATIONS

PENTEL specifications for PM@ marking pen, unknown.*
LYSOL Fresh Scent Cling. Thick Liquid Toilet Bowl Cleaner bottle labels, 1995.*

* cited by examiner

*Primary Examiner*—Charles E. Phillips
(74) *Attorney, Agent, or Firm*—John L. Rogitz

(57) ABSTRACT

A five-second leak detection technique is used to test for invisible leaks in toilets and similar fixtures. Because of its speed it is particularly useful for large apartment complexes, condominiums and hotels where it is desirable to check hundreds of toilets in a short time. It's clear-cut results and high visibility make it ideal for home use as it unequivocally identifies seeps and slow leaks that may be undetectable otherwise. Checking is done by applying a swath of liquid with a high color density across the porcelain surface just below the rim drain holes in the toilet. If the a toilet is leaking, tiny rivulets of water draining from these holes will immediately cause white streaks in the dense colored swath, alerting the operator to the presence of a leak.

11 Claims, 3 Drawing Sheets

LEAK DETECTION SYSTEM FOR PLUMBING FIXTURES

BACKGROUND OF THE INVENTION

Water has become a scarcer commodity throughout the world and even in the Western United States, conservation wars are being waged one battle at a time, with restricted-flow shower heads for residential use, tamper-proof in-line flow restrictors for hotels and apartments, volume occupying blocks for toilet tanks, and so forth. Small amounts of water saved, multiplied by millions of consumers adds up to enough water in many places to turn a shortage into an adequate supply.

One of the greatest culprits for wasting water is the toilet. Of the water consumed in a typical house, toilet leakage will account for between 5% and 13%, depending on how conservation-conscious the residents are, according to a HUD study conducted in 1984 by Brown & Coldwell. A toilet may leak at the flapper valve which separates the toilet tank from the toilet, or the float-regulated fill value. Depending on the nature of the leak, it is very likely to be silent and invisible. A typical toilet has a multiplicity of flush water holes just beneath the rim, and the slow, or not-so-slow, draining of leaked water down the porcelain bowl of the toilet will not be detected in the ordinary course of toilet use. Even on close inspection slow leaks may not be observable. Unfortunately, they are observable on the water bill and show up dramatically in the accumulative water loss of an entire population. A slow leak running 24 hours a day, seven days a week multiplied times millions is a lot of water.

Except in the unlikely event that water is dripping onto the floor through the toilet tank, if a toilet is leaking, the flush water must run through the manifold and exit through the flush holes and the trap, as there is no other path for the water to take. Therefore, traditionally the manner of checking for leaks in a toilet involved putting a tablet of soluble blue dye in the toilet tank and waiting for blue streaks to show up in the bowl. This technique however suffers from the drawbacks of the relatively long time period the test requires, and results that may be erratic. It may take 10 to 20 minutes for the dye to dissolve adequately to run an accurate test. This by itself renders the test subject to inaccuracy, inasmuch as an impatient Householder could well walk away prematurely believing there was no leakage.

Additionally, if the toilet or bowl has been using the cosmetic, sanitizing or disinfectant blue (or other color) dye that is popular in some circles, it is not possible tell if the blue dye of the tablet is coming through or not. It is necessary to actually drain the toilet tank, remove the coloring agent, flush the bowl once or twice with clear water and then put in the dye tablet. Even then, the blue dye from the tablet becomes so diluted because of its small volume compared to the voluminous water supply in the toilet tank that a small leak may not be detected. And in a large hotel setting, for example, it can be imagined how this technique would not be very popular amongst maintenance personal, who want to be able to go in, check for a leak quickly, fix it if exists, and move on the next installation. Return trip sequencing and delays are only frustrating to overworked maintenance staffers.

The commercially popular toilets that have no tank but rather use a high-flow-rate "flushometer" valve, generally known by the name of the most prevalent manufacturer as the "Sloan™ valve", also leak, as the gaskets deteriorate, and should be replaced. Since there is no tank to put the blue dye into, there is currently no way at all to check these installations for leaks. Therefore, they will leak more and more until they finally make enough noise to attract a maintenance man's attention.

Considering the enormous amount of water that is lost through toilet leakage as can be seen from the charts in the accompanying drawings, it is of significant importance to have a inexpensive, quick, accurate and sensitive test for leakage for toilets primarily, but also for urinals, bidets and any other kind of fixture which rinses a porcelain surface area through small overlying holes, laying the foundation for invisible and silent leakage to begin as valve seats and valves wear, warp, or stiffen with age.

SUMMARY OF THE INVENTION

The instant invention fulfills all of these criteria for quick, inexpensive, accurate, and very sensitive tests for leaking toilets. It is the reverse of the dye table technique, in which the observer watches for blue (or other colored) streaks to appear on the white porcelain background of the toilet bowl. According to the instant technique, the observer squirts or otherwise applies a swath of dense, thick dye liquid just under the flush holes and watches for white lines to appear as the clear water drains from the holes and carries the dye with it just beneath the hole area leaving vertical columns of white on a back ground of deep blue, for example. With the right kind of dye liquid, the blue swath is very dense optically, yet the dye is highly soluble so that the rivulets of water almost instantly become-visible as little white stalactite-looking erosion lines begin appearing in the dye swath.

So fast is this technique that even a minute leak will become visible within five seconds in most cases, or ten seconds in the worst case scenario. This enables a single worker to test a hundred toilets or more in a day, compared to perhaps twenty using the old dye tablet technique. A squirt of dye with a single swipe of the hand, waiting only a moment to check for the white columns, brings the entire test from start to finish down to a time of ten seconds or less. One metropolitan water district study concluded that in a comprehensive survey of residential leaks, the test would save 19 minutes per toilet over conventional testing methods. The cost of labor that would be saved in such a survey would be huge.

And there are no trade-offs at all, as the material that is used is biodegradable, inexpensive, and will not permanently stain carpets or clothing. In addition to saving materials costs and the time of the worker, a real advantage lies in the much higher likelihood that the tests will actually be performed, and, that minor leaks which would otherwise go unobserved, will be detected. A tedious test, or one that requires return visits, or waiting for a period of minutes, is a frequently skipped test, especially since immediate catastrophic consequences do not flow from an uncorrected slow leak. But testing ignored for a period of years results in an enormous water loss that can now be curbed with a simple test that no one would feel compelled to dodge.

DETAILED DESCRIPTION OF THE PREFERRED EMBODIMENT

Figure 1:
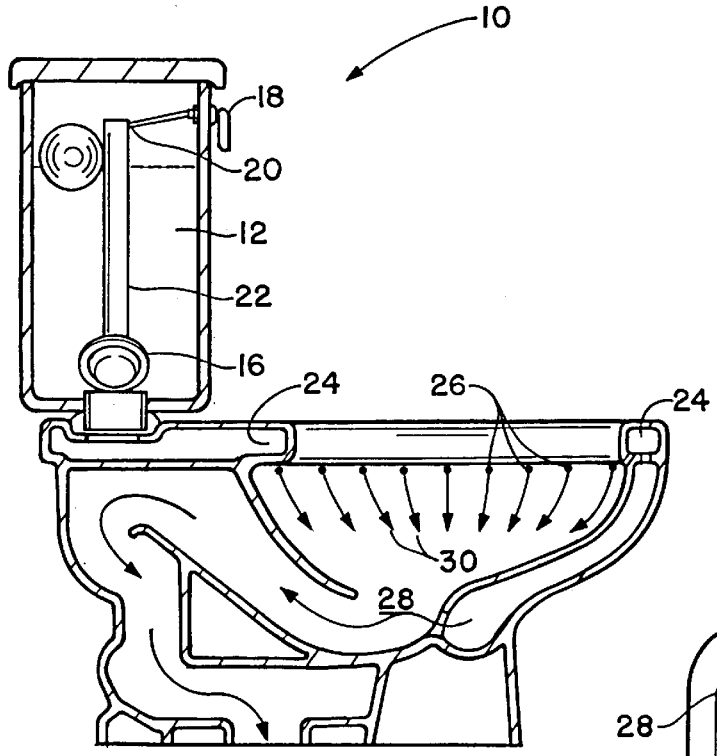
FIG. 1 is a vertical section taken longitudinally through a typical toilet illustrating the circulation of drain water from the toilet tank through the rim manifold and out the flush holes.

The toilet shown in FIG. 1 is a typical residential household toilet 10. It has a water closet 12 and a discharging opening 14 which is covered by a flapper valve, or just a "flapper", 16. When the toilet is flushed by rotating the handle 18, typically the flapper will be lifted off of its seat in the discharge opening through a connecting mechanism 20 which includes a rod and a chain. Once flipped up, the flapper will not seat again until the water is nearly completely drained, due to a floatation factor built into the flapper. An inlet for fresh water, which is not shown in the drawings, is typically controlled by a floating ball which terminates the flow of refill water when the level is appropriately high in the toilet tank for the next flush.

The water will leak out of the toilet tank either around the flapper 16 or through the overflow standpipe 22. Either way, it is introduced to the toilet through the annular manifold 24 around the rim of the bowl. From the rim, the water drains through the rim wash holes 26, swirling around the toilet bowl and out the trap 28. When there is a leak, the slow trickle of water running down the side of the bowl as drawn in FIG. 1 at 30, is undetectable. By the nature of the design of the toilet trap, the water level in the bowl does not increase. If the leak occurs at the fresh water inlet into the toilet tank, it will probably be noiseless. If the flapper has become brittle or warped, permitting water to leak around its edges, there may be the sound of the periodic refilling of the toilet as the ball cock valve float drops lower in the toilet tank to the point where inflow begins again. However, even this is not necessarily significant if the inhabitants are apartment tenants or hotel who either do not care about water leaks, or are so used to them they assume that this is the normal way for a toilet to sound.

Figure 3:
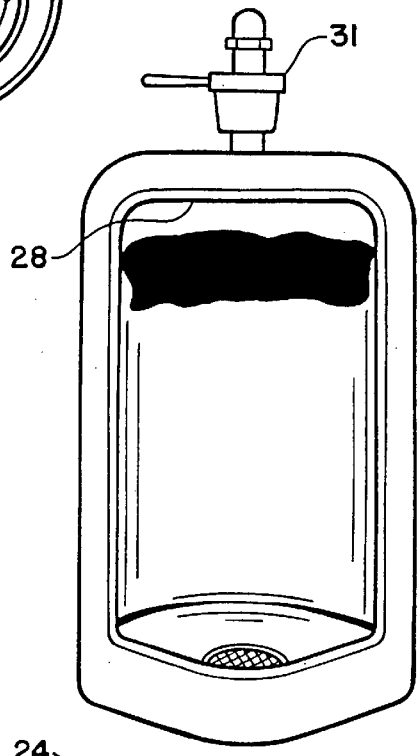
FIG. 3 illustrates use of the testing liquid on a urinal having a Sloane™ valve.
Figure 9:
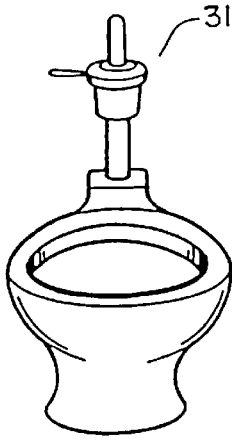
FIG. 9 is a front perspective of a commercial Sloan® valve toilet.

FIG. 9 illustrates a typical toilet with a Sloan® valve 31, similar to the urinal shown in FIG. 3. As the seals of Sloan valves wear, slow leaking begins to occur. Due to the commercial nature of these units, those who use them do not generally care if they leak or not, and the leaks are generally silent, so that they often simply go unnoticed. This is major problem since Sloan™ valves are almost universally used in toilets and urinals in hospital bathrooms, government operated facilities, and other public restrooms. There is currently no practical method of testing these commercial valves.

Figure 2:
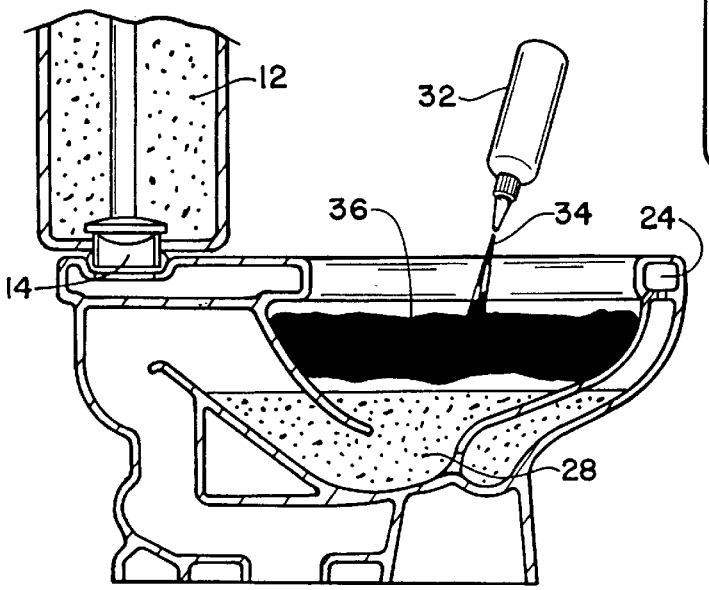
FIG. 2 illustrates the application of the testing liquid to the upper portion of a typical toilet bowl, which could equally well be a bidet bowl, just below the flush holes.
Figure 4:
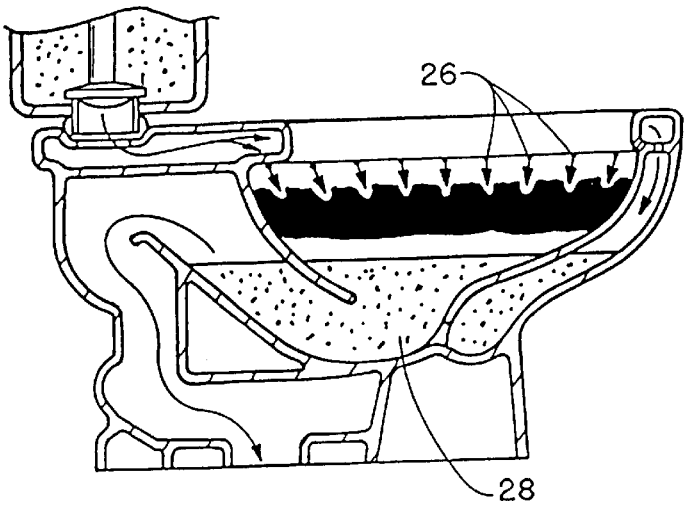
FIG. 4 illustrates the beginning of water erosion on the swath of dye liquid.
Figure 5:
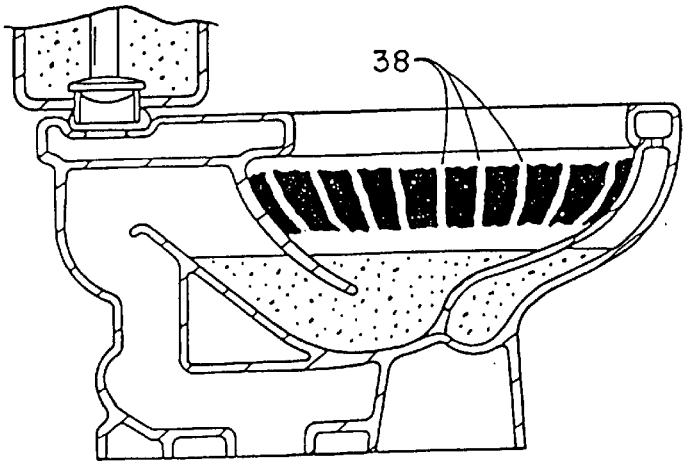
FIG. 5 illustrates a swath of dye as it appears after a few seconds in a leaky toilet.

In any event, the leakage of water down the open bowl of the toilet, bidet or urinal is the logical place to check in this class of fixtures. According to the instant invention, an applicator bottle 32 of dense blue dye liquid is squirted to apply the dye 34 around the toilet bowl as shown in FIG. 2, creating a continuous or generally continuous swath 36 of dye just beneath the flush holes. This procedure can be done in a second or two, as positioning accuracy is not critical. A quick squirt around the entire perimeter of the bowl will create a bead of the dye liquid which would immediately sag to create a swath as shown in FIG. 2. This swath will be adequate to reveal any leaks without requiring any particular care in its application. A quick, effortless squirt is all that it takes. Often, the previously invisible leaks will be visible at the start of the squirt almost before the squirter makes its near-360 degree sweep. If the tester sees no white columns beginning to emerge, he may wait a few seconds. If no visible columns appear after five to ten seconds of observing, he can be sure that this toilet is not leaking. If there is a leak, the very distinct column pattern of FIG. 5 will manifest itself, but of course the tester is aware of the leakage pattern long before the high contrast pattern of FIG. 5 develops.

Ideally the tester is also the repairman, who upon finding a leakage situation, removes the cover of the toilet tank to determine whether it is the flapper or the fresh water inlet that is the culprit, and makes a quick repair on the spot. The old flapper can be popped off and a new one installed very quickly. An inlet valve might take a little more time. Even if the entire procedure takes five minutes, it is well worth the investment to prevent a leak that will continue twenty-four hours a day forever, often getting progressively worse, until it is fixed. The tester needs no special training, and could be anyone, such as a home owner or hotel maid, who may not themselves be prepared to fix the fixture, but would call the plumber or notify building maintenance.

The liquid that is used in this test is not itself part of the invention in any particular formulation. An endless range of formulations can be made that would be adequate. Aside from high optical density, the dye should be highly soluble in water, and the liquid should be somewhat thicker than water and slightly tacky, similar to watered-down honey, but of course with an intense, probably blue, color. The slight tackiness enables it to cling to the sides of the bowl for the few seconds required for the test, and the high solubility of course enables the dye to be flushed clean immediately so the toilet is not unsightly. Many suitable commercially available dyes are completely harmless, biodegradable, and do not stain clothing.

Figure 8:
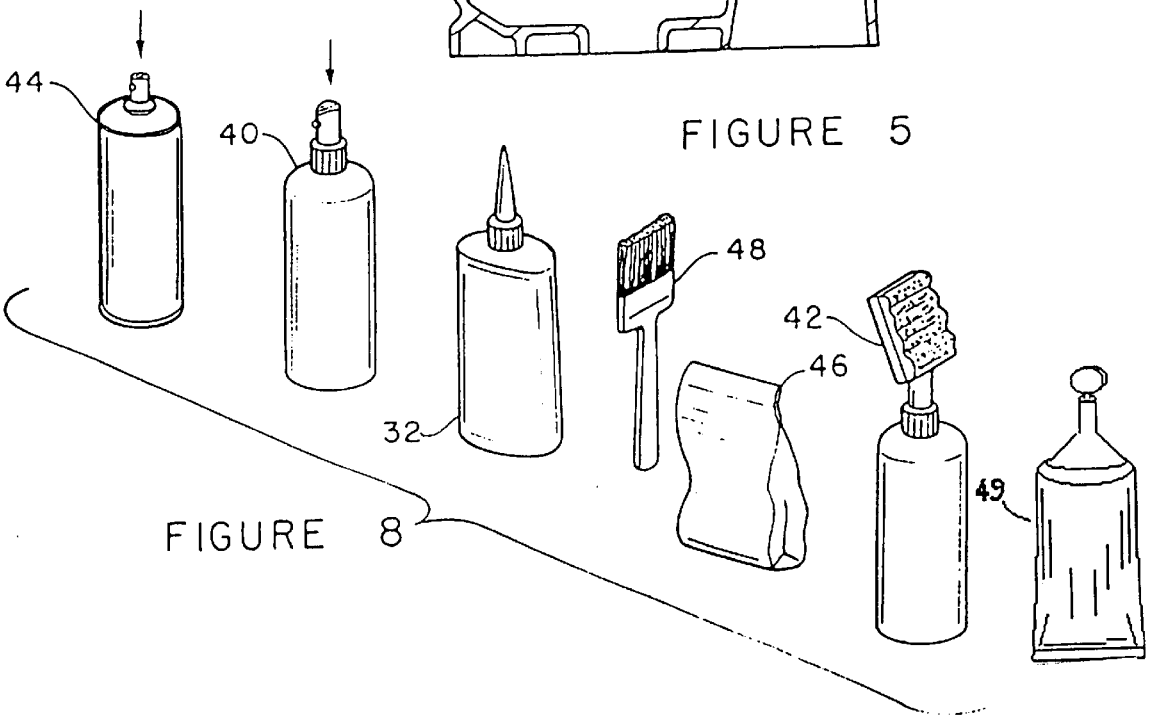
FIG. 8 illustrates four possible applicator styles.
Figure 6:
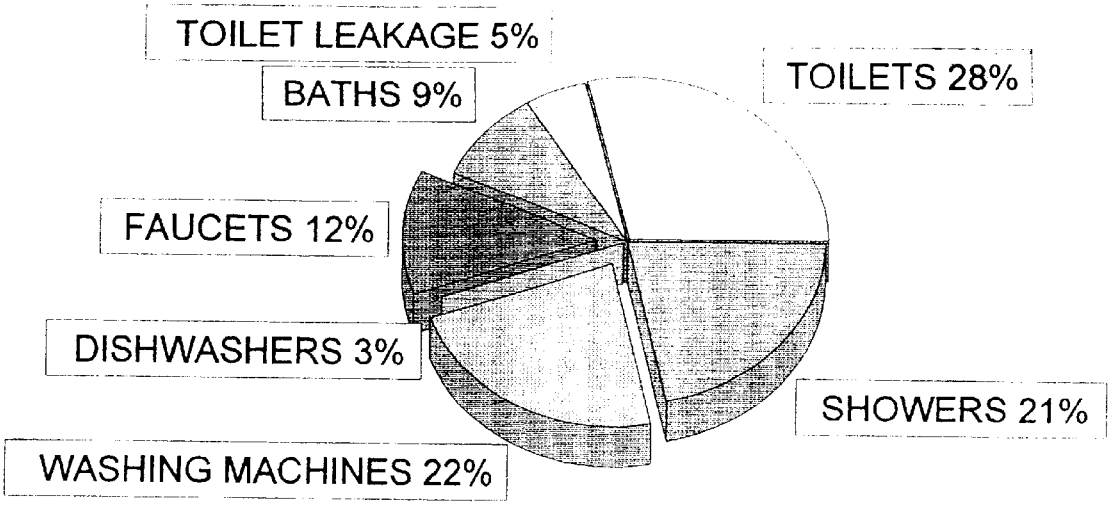
FIG. 6 is a pie chart illustrating the proportion of toilet leakage in a typical household that is not into water conservation (5%)
Figure 7:
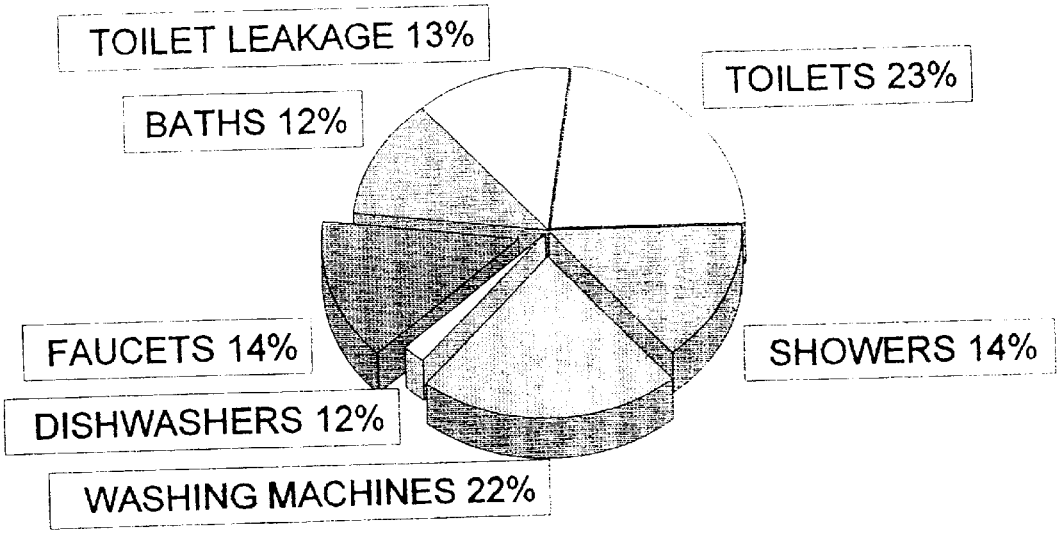
FIG. 7 illustrates the even larger percentage of waste water that will go down the toilet from leaks from a typical household which is conscious of conserving water (13%)

As shown in FIG. 8, the dye applicator can be a simple squirt bottle 38, a spray bottle 40, or a dispenser which feeds the dye into a sponge block as shown at 42, an aerosol can 44, a paint brush 48, or some other porous mass to smear dye onto the toilet bowl. A bottle, or a one-, two-, or three- dose packet 46 or tube 49, could be mailed to householders with an instruction sheet and possibly a simple repair kit. Two ounces is generally ideal, with a dispensing corridor eighty- to ninety- thousandths of an inch wide in a non-pressurized dispensing container . The minor cost of such equipment is insignificant compared to the cumulative savings, which can easily run to over a hundred dollars a year for one toilet. The national water savings can be imagined from inspecting FIGS. 6 and 7.

It is hereby claimed:

1. A method of checking for water leakage in a fixture having a surface that is periodically flushed by a flushing mechanism which introduces water from a source through ports above said surface such that water subsequently flows immediately over the surface to a drain, said mechanism being designed to then terminate the flow until the next periodic flush, said method steps comprising the following steps:

(a) applying a swath of dye having a color visually distinct from the color of said surface to said surface below said ports in places at which it is desired to check for trickle leaks from said source;

(b) after applying the dye to the surface and before flushing the fixture, observing said swath of dye; and (c) noting any streaks down through said swath of dye which reveal the surface through said dye before flushing the fixture and after applying the dye to determine whether water from the source is leaking through one or more of the ports when the fixture is not being flushed.

2. A method according to claim 1 wherein said fixture is a toilet, said surface is the surface of the toilet bowl of said toilet, said ports communicate with an annular water reservoir disposed at the top of said bowl defining an annular arrangement of said ports, and step (a) comprises applying said swath of dye substantially continuously around the upper portion of substantially the entire bowl beneath said array.

3. A method according to claim 2 wherein said dye is a liquid contained in a squirt bottle having a directional squirting tip and step (a) comprises squirting a line of dye around an upper potion of said bowl.

4. A method according to claim 2 wherein said toilet bowl has waterline and exposed surface above said waterline, and step (a) comprises coating said exposed surface substantially in its entirety.

5. A method according to claim 1 wherein said dye is a liquid contained in a spray bottle and step (a) comprises spraying said dye from said spray bottle.

6. A method according to claim 1 wherein said fixture is a urinal having a back splash surface and step (a) comprises applying a swath of dye across said backslash surface.

7. A method according to claim 1 wherein said fixture is a bidet having a substantially continuous annular flushable surface and said source comprises a substantially continuous flushing water reservoir disposed above said flushing surface, and step (a) comprises applying said swath of dye across said flushable surface below said reservoir.

8. A method according to claim 1 and including the step between steps (a) and (c) of waiting a number of seconds between the execution of steps (a) and (c).

9. A method according to claim 8 wherein the step between steps (a) and (c) comprises counting to five.

10. A method according to claim 1 wherein step (a) comprises applying said swath of dye to a surface of a fixture wherein said source is a Sloan™ valve.

11. A method for testing for water leakage from the flush ports of a toilet having a flush surface, comprising the steps of:

squirting a swath of dye onto the surface just below the flush ports;

before flushing the toilet, observing the swath of dye to render an observation; and correlating streaks observed in the swath of dye during the observation to water leakage.

* * * * *